US009924267B2

(12) United States Patent
Mendes et al.

(10) Patent No.: US 9,924,267 B2
(45) Date of Patent: Mar. 20, 2018

(54) DEVICE FOR CONTROLLING A LOUDSPEAKER

(71) Applicant: DEVIALET, Paris (FR)

(72) Inventors: Eduardo Mendes, Chabeuil (FR); Pierre-Emmanuel Calmel, Le Chesnay (FR); Antoine Petroff, Paris (FR); Jean-Loup Afresne, Paris (FR)

(73) Assignee: DEVIALET, Paris (FR)

( * ) Notice: Subject to any disclaimer, the term of this patent is extended or adjusted under 35 U.S.C. 154(b) by 0 days.

(21) Appl. No.: 15/121,633

(22) PCT Filed: Feb. 18, 2015

(86) PCT No.: PCT/EP2015/053429

§ 371 (c)(1),
(2) Date: Aug. 26, 2016

(87) PCT Pub. No.: WO2015/128237

PCT Pub. Date: Sep. 3, 2015

(65) Prior Publication Data

US 2016/0366515 A1 Dec. 15, 2016

(30) Foreign Application Priority Data

Feb. 26, 2014 (FR) ..... 14 51563

(51) Int. Cl.
*H04R 3/00* (2006.01)
*H04R 3/04* (2006.01)
(Continued)

(52) U.S. Cl.
CPC ..... *H04R 3/002* (2013.01); *H04R 1/025* (2013.01); *H04R 3/04* (2013.01); *H04R 29/003* (2013.01)

(58) Field of Classification Search
CPC ..... H04R 3/002; H04R 29/001; H04R 3/007; H04R 29/003; H04R 3/04; H04R 1/025
(Continued)

(56) References Cited

U.S. PATENT DOCUMENTS 5,694,476 A 12/1997 Klippel
6,058,195 A 5/2000 Klippel
(Continued)

FOREIGN PATENT DOCUMENTS

EP 1351543 10/2013
GB 2413233 10/2005
WO WO 2013182901 A1 * 12/2013

OTHER PUBLICATIONS

International Search Report for PCT/EP2015/053429, dated Apr. 23, 2015.

(Continued)

*Primary Examiner* — Melur Ramakrishnaiah
(74) *Attorney, Agent, or Firm* — B. Aaron Schulman, Esq.; Stites & Harbison, PLLC.

(57) ABSTRACT

The present invention relates to a device for controlling a loudspeaker (14) in an enclosure, comprising:

an input for an audio signal ($S_{audio_ref}$) to be reproduced;

an output for supplying an excitation signal from the loudspeaker;

means (26, 36, 38, 70, 80, 90) for calculating the excitation signal of the loudspeaker (14) at each moment based on the audio signal ($S_{audio_ref}$).

It comprises means (26, 36, 38, 70, 80, 90) for calculating the excitation signal, means (24, 25) for calculating a desired dynamic value ($A_{ref}$) of the diaphragm of the loudspeaker based on the audio signal ($S_{audio_ref}$) to be reproduced and the structure of the enclosure, the means (25) for calculating the desired dynamic value ($A_{ref}$) of the loudspeaker diaphragm being able to apply a correction that is different from (Continued)

the identity, and taking account of structural dynamic values ($x_o$, $v_o$) of the enclosure that are different from the only dynamic values relative to the loudspeaker diaphragm, and the means (26, 36, 38, 70, 80, 90) for calculating the excitation signal of the loudspeaker being able to calculate the excitation signal based on the desired dynamic value ($A_{ref}$) of the loudspeaker diaphragm.

6 Claims, 5 Drawing Sheets

(51) Int. Cl.
*H04R 1/02* (2006.01)
*H04R 29/00* (2006.01)

(58) Field of Classification Search
USPC ..... 381/94.8, 96, 400, 59, 58
See application file for complete search history.

(56) References Cited

U.S. PATENT DOCUMENTS

| | | | | |
|---|---|---|---|---|
| 6,684,204 | B1 | 1/2004 | Lal | |
| 8,023,668 | B2 | 9/2011 | Pfaffinger | |
| 8,761,409 | B2 | 6/2014 | Pfaffinger et al. | |
| 9,301,072 | B2 | 3/2016 | Reining | |
| 2003/0210798 | A1 | 11/2003 | Ohyava | |
| 2006/0104451 | A1* | 5/2006 | Browning ..... | H04R 29/003 381/59 |
| 2010/0172516 | A1 | 7/2010 | Lastrucci | |
| 2012/0288118 | A1 | 11/2012 | Gautama | |
| 2015/0201294 | A1 | 7/2015 | Risberg et al. | |

OTHER PUBLICATIONS

Written Opinion for PCT/EP2015/053429, dated Apr. 23, 2015.
Preliminary Search Report for FR1451564, completed Oct. 31, 2014.

* cited by examiner

DEVICE FOR CONTROLLING A LOUDSPEAKER

The present invention relates to a device for controlling a loudspeaker in an enclosure, comprising:

- an input for an audio signal to be reproduced;
- an output for supplying an excitation signal from the loudspeaker;
- means for calculating the excitation signal of the loudspeaker at each moment based on the audio signal.

Loudspeakers are electromagnetic devices that convert an electrical signal into an acoustic signal. They introduce a nonlinear distortion that may greatly affect the obtained acoustic signal.

Many solutions have been proposed to control loudspeakers so as to make it possible to eliminate the distortions in the behavior of the loudspeaker through an appropriate command.

A first type of solution uses mechanical sensors, typically a microphone, in order to implement an enslavement that makes it possible to linearize the operation of the loudspeaker. The major drawback of such a technique is the mechanical bulk and the non-standardization of the devices, as well as the high costs.

Examples of such solutions are for example described in documents EP 1 351 543, U.S. Pat. No. 6,684,204, US 2010/017 25 16, and U.S. Pat. No. 5,694,476.

In order to avoid the use of an unwanted mechanical sensor, open loop-type controls have been considered. They do not require costly sensors. They optionally only use a measurement of the voltage and/or current applied across the terminals of the loudspeaker.

Such solutions are for example described in documents U.S. Pat. No. 6,058,195 and U.S. Pat. No. 8,023,668.

These solutions nevertheless have drawbacks in that the set of nonlinearities of the loudspeaker is not taken into account and these systems are complex to install and do not offer complete freedom for the choice of the corrected behavior obtained from the equivalent loudspeaker.

Document U.S. Pat. No. 6,058,195 uses a so-called "mirror filter" technique with current control. This technique makes it possible to eliminate the nonlinearities in order to obtain a predetermined model. The implemented estimator E produces an error signal between the measured voltage and the voltage predicted by the model. This error is used by the update circuit of the parameters U. In light of the number of estimated parameters, the convergence of the parameters toward their true values is highly improbable under normal operating conditions.

U.S. Pat. No. 8,023,668 proposes an open loop control model that offsets the unwanted behaviors of the loudspeaker relative to a desired behavior. To that end, the voltage applied to the loudspeaker is corrected by an additional voltage that cancels out the unwanted behaviors of the loudspeaker relative to the desired behavior. The control algorithm is done by discrete-time discretization of the model of the loudspeaker. This makes it possible to predict the position the diaphragm will have in the following time and compare that position with the desired position. The algorithm thus performs a kind of infinite gain enslavement between a desired model of the loudspeaker and the model of the loudspeaker so that the loudspeaker follows the desired behavior.

As in the preceding document, the command implements a correction that is calculated at each moment and added to the input signal, even though this correction in document U.S. Pat. No. 8,023,668 does not implement a closed feedback loop.

The mechanisms for calculating a correction added to the input signal do not take into account the structure of the enclosure when the latter is not a closed enclosure.

The invention aims to propose a satisfactory command of a loudspeaker arranged in a non-closed enclosure and that takes account of the structure of the enclosure.

To that end, the invention relates to a device for controlling a loudspeaker of the aforementioned type, characterized in that upstream, it comprises means for calculating the excitation signal, means for calculating a desired dynamic value of the diaphragm of the loudspeaker based on the audio signal to be reproduced and the structure of the enclosure, the means for calculating the desired dynamic value of the loudspeaker diaphragm being able to apply a correction that is different from the identity, and taking account of structural dynamic values of the enclosure that are different from the only dynamic values relative to the loudspeaker diaphragm, and the means for calculating the excitation signal of the loudspeaker being able to calculate the excitation signal based on the desired dynamic value of the loudspeaker diaphragm.

According to specific embodiments, the control device comprises one or more of the following features:

- the enclosure comprises a vent and the structural dynamic values of the enclosure comprise at least one derivative of predetermined order of the position of the air displaced by the enclosure;
- the structural dynamic values of the enclosure comprise the position of the air displaced by the enclosure;
- the structural dynamic values of the enclosure comprise the speed of the air displaced by the enclosure;
- the enclosure is a vented enclosure and the structural dynamic values of the enclosure depend on at least one of the following parameters:
  - acoustic leakage coefficient of the enclosure
  - inductance equivalent to the mass of air in the vent
  - compliance of the air in the enclosure;
- the enclosure is a passive radiator enclosure and the structural dynamic values of the enclosure depend on at least one of the following parameters:
  - acoustic leakage coefficient of the enclosure
  - inductance equivalent to the mass of the diaphragm of the passive radiator
  - compliance of the air in the enclosure
  - mechanical losses of the passive radiator
  - mechanical compliance of the diaphragm., The invention will be better understood upon reading the following description, provided solely as an example, and done in reference to the drawings, in which:

Figure 1:
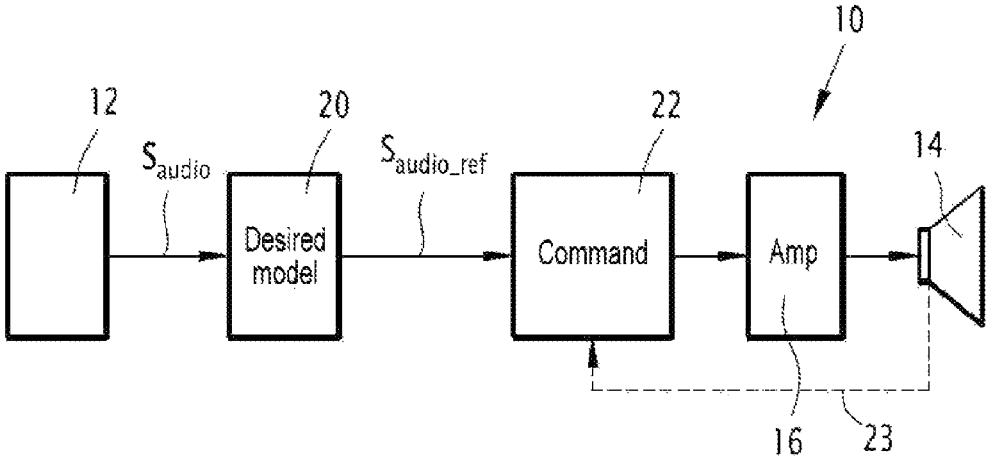
FIG. 1 is a diagrammatic view of a sound retrieval installation.

The sound retrieval installation 10 illustrated in FIG. 1 comprises, as is known in itself, a module 12 for producing an audio signal, such as a digital disc reader connected to a loudspeaker 14 of a vented enclosure through a voltage amplifier 16. Between the audio source 12 and the amplifier 16, a desired model 20, corresponding to the desired behavior model of the enclosure, and a control device 22 are arranged, successively in series. This desired model is linear or nonlinear.

According to one particular embodiment, a loop 23 for measuring a physical value, such as the temperature of the magnetic circuit of the loudspeaker or the intensity circulating in the coil of the loudspeaker, is provided between the loudspeaker 14 and the control device 22.

The desired model 20 is independent of the loudspeaker used in the installation and its model.

Figure 2:
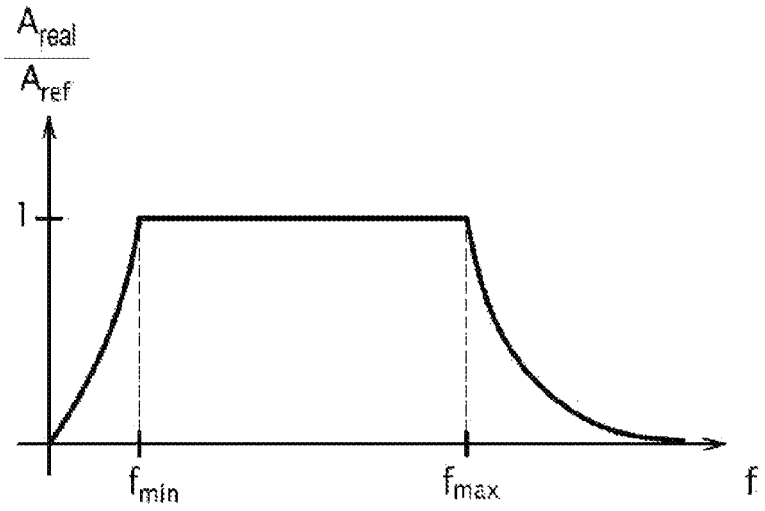
FIG. 2 is a curve illustrating a desired sound retrieval model for the installation.

The desired model 20 is, as shown in FIG. 2, a function expressed based on the frequency of the ratio of the amplitude of the desired signal, denoted $S_{audio_ref}$, to the amplitude $S_{audio}$ of the input signal from the module 12.

Advantageously, for frequencies below a frequency $f_{min}$, this ratio is a function converging toward zero when the frequency tends towards zero, to limit the reproduction of excessively low frequencies and thereby avoid movements of the loudspeaker diaphragm outside ranges recommended by the manufacturer.

The same is true for high frequencies, where the ratio tends towards zero beyond a frequency $f_{max}$ when the frequency of the signal tends toward infinity.

According to another embodiment, this desired model is not specified and the desired model is considered to be unitary.

Figure 3:
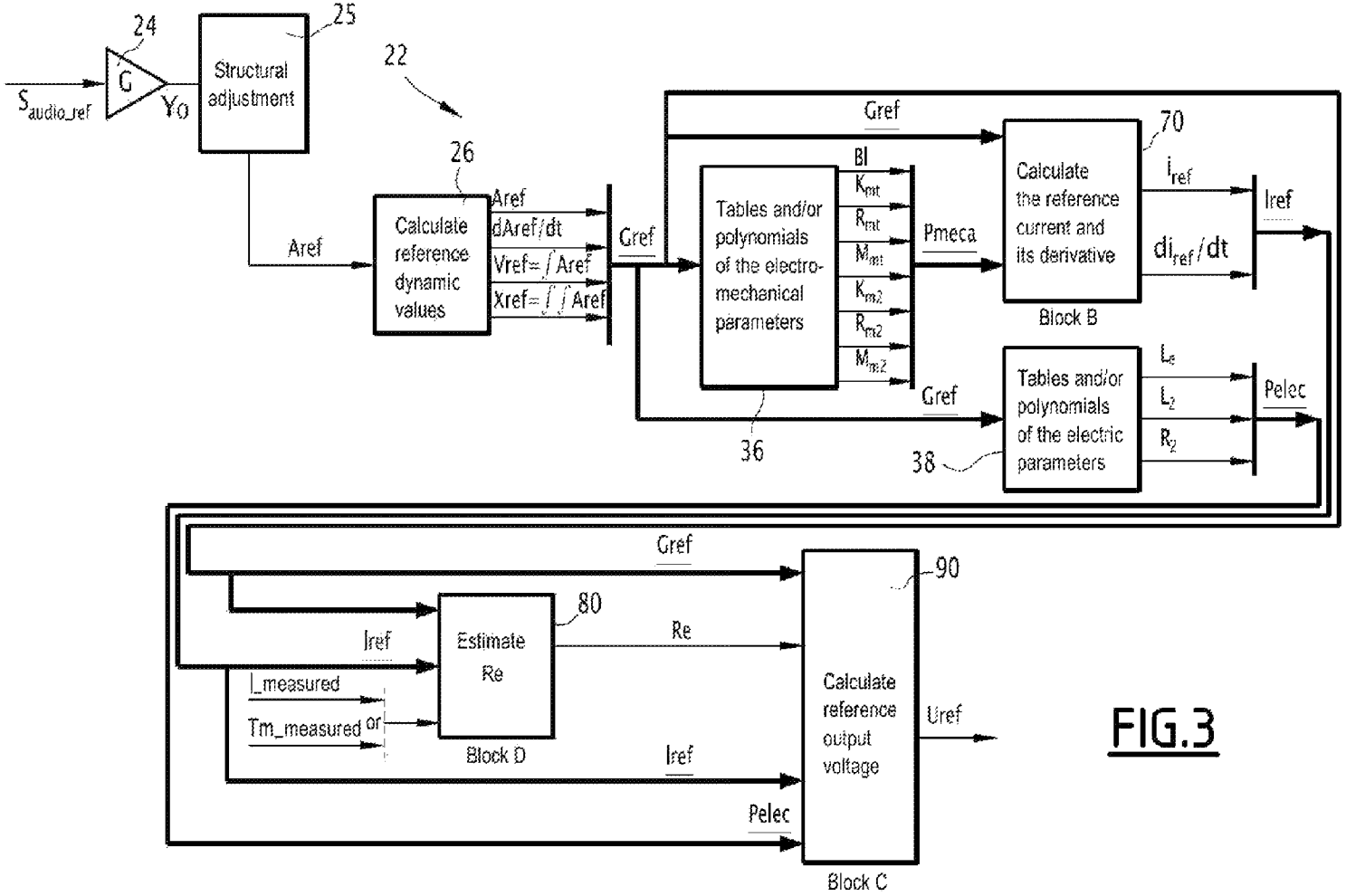
FIG. 3 is a diagrammatic view of the loudspeaker control unit.

The control device 22, the detailed structure of which is illustrated in FIG. 3, is arranged at the input of the amplifier 16. This device is able to receive, as input, the audio signal $S_{audio_ref}$ to be reproduced as defined at the output of the desired model 20 and to provide, as output, a signal $U_{ref}$, forming an excitation signal of the loudspeaker that is supplied for amplification to the amplifier 16. This signal $U_{ref}$ is suitable for taking account of the nonlinearity of the loudspeaker 14.

The control device 22 comprises means for calculating different quantities based on derivative or integral values of other quantities defined at the same moments.

For the calculating needs, the values of the quantities not known at the moment n are taken to be equal to the corresponding values at the moment n−1. The values at the moment n−1 are preferably corrected by an order 1 or 2 prediction of their values using higher-order derivatives known at the moment n−1.

According to the invention, the control device 22 implements a control partly using the differential flatness principle, which makes it possible to define a reference control signal of a differentially flat system from sufficiently smooth reference trajectories.

As illustrated in FIG. 3, the control module 22 receives, as input, the audio signal $S_{audio_ref}$ to be reproduced from the desired model 20. A unit 24 for applying a unit conversion gain, depending on the peak voltage of the amplifier 16 and an attenuation variable between 0 and 1 controlled by the user, ensures the passage of the reference audio signal $S_{audio_ref}$ to a signal $\gamma_0$, image of a physical value to be reproduced. The signal $\gamma_0$ is, for example, an acceleration of the air opposite the loudspeaker or a speed of the air to be moved by the loudspeaker 14. Hereinafter, it is assumed that the signal $\gamma_0$ is the acceleration of the air set in motion by the enclosure.

At the output of the amplification unit 24, the control device comprises a unit 25 for structural adaptation of the signal to be reproduced based on the structure of the enclosure in which the loudspeaker is used. This unit is able to provide a desired reference value $A_{ref}$ at each moment for the loudspeaker diaphragm from a corresponding value, here the signal $\gamma_0$, for the displacement of the air set in motion by the loudspeaker enclosure.

Thus, in the considered example, the reference value $A_{ref}$, calculated from the acceleration of the air to be reproduced $\gamma_0$, is the acceleration to be reproduced for the loudspeaker diaphragm so that the operation of the loudspeaker imposes an acceleration on the air $\gamma_0$.

Figure 4:
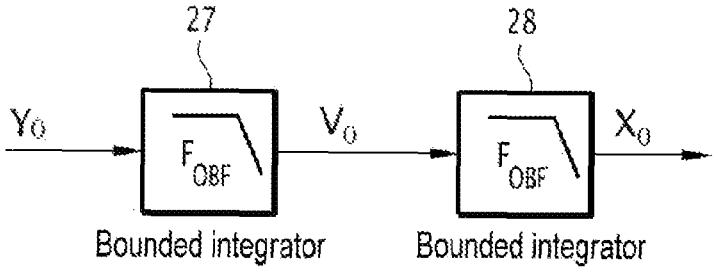
FIG. 4 is a detailed diagrammatic view of the structural adaptation unit.

FIG. 4 shows a detail of the structural adaptation unit 25. The input $\gamma_0$ is connected to a bounded integration unit 27, the output of which is in turn connected to another bounded integration unit 28.

Thus, at the output of the units 27 and 28, the first integral $v_0$ and the second integral $x_0$ are obtained of the acceleration $\gamma_0$.

The bounded integration units are formed by a first-order low-pass filter and are characterized by a cutoff frequency $F_{OBF}$.

The use of a bounded integration unit makes it possible for the values used in the control device 22 not to be the derivatives or integrals of one another except in the useful bandwidth, i.e., for frequencies above the cutoff frequency $F_{OBF}$. This makes it possible to control the low-frequency excursion of the values in question.

During normal operation, the cutoff frequency $F_{OBF}$ is chosen so as not to influence the signal in the low frequencies of the useful bandwidth.

The cutoff frequency $F_{OBF}$ is taken to be lower than one tenth of the frequency $f_{min}$ of the desired model 20.

In the case of a vented enclosure in which the loudspeaker is mounted in a housing opened by a vent, the unit 25 produces the desired reference acceleration for the diaphragm $A_{ref}$ via the following relationship:

$$A_{ref} = \gamma_D = \gamma_0 + \frac{K_{m2}}{R_{m2}} v_0 + \frac{K_{m2}}{M_{m2}} x_0$$

With:

$R_{m2}$: acoustic leakage coefficient of the enclosure;

$M_{m2}$: inductance equivalent to the mass of air in the vent;

$K_{m2}$: stiffness of the air in the enclosure;

$x_0$: position of the total air displaced by the diaphragm and the vent;

$$v_0 = \frac{dx_0}{dt}:$$

speed of the total air displaced by the diaphragm and the vent;

$$\gamma_0 = \frac{dv_0}{dt}:$$

acceleration of the total displaced air.

In this case, the reference acceleration desired for the diaphragm $A_{ref}$ is corrected for structural dynamic values $x_o$, $v_o$, of the enclosure, the latter being different from the dynamic values relative to the loudspeaker diaphragm.

This reference value $A_{ref}$ is introduced into a unit 26 for calculating reference dynamic values able to provide, at each moment, the value of the derivative relative to the time of the reference value denoted $dA_{ref}/dt$, as well as the values of the first and second integrals relative to the time of that reference value, respectively denoted $V_{ref}$ and $X_{ref}$.

The set of reference dynamic values is denoted hereinafter as $G_{ref}$.

Figure 5:
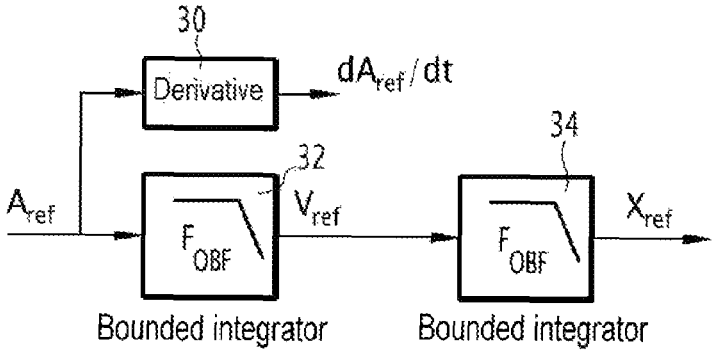
FIG. 5 is a detailed diagrammatic view of the unit for calculating reference dynamic values.

FIG. 5 shows a detail of the calculating unit 26. The input $A_{ref}$ is connected to a derivation unit 30 on the one hand and to a bounded integration unit 32 on the other hand, the output of which is in turn connected to another bounded integration unit 34.

Thus, at the output of the units 30, 32 and 34, the derivative of the acceleration $dA_{ref}dt$, the first integral $V_{ref}$ and the second integral $X_{ref}$ of the acceleration are respectively obtained.

The bounded integration units are formed by a first-order low-pass filter and are characterized by a cutoff frequency $F_{OBF}$.

The use of a bounded integration unit makes it possible for the values used in the control device 22 not to be the derivatives or integrals of one another except in the useful bandwidth, i.e., for frequencies above the cutoff frequency $F_{OBF}$. This makes it possible to control the low-frequency excursion of the values in question.

During normal operation, the cutoff frequency $F_{OBF}$ is chosen so as not to influence the signal in the low frequencies of the useful bandwidth.

The cutoff frequency $F_{OBF}$ is taken to be lower than one tenth of the frequency $f_{min}$ of the desired model 20.

The control device 22 comprises, in a memory, a table and/or a set of electromechanical parameter polynomials 36 as well as a table and/or a set of electrical parameter polynomials 38.

These tables 36 and 38 are able to define, based on reference dynamic values $G_{ref}$ received as input, the electromechanical $P_{méca}$ and electrical $P_{élect}$ parameters, respectively. These parameters $P_{méca}$ and $P_{élec}$ are respectively obtained from a mechanical modeling of the loudspeaker as illustrated in FIG. 6, where the loudspeaker is assumed to be installed in a vented enclosure, and an electrical model of the loudspeaker as illustrated in FIG. 7.

The electromechanical parameters $P_{méca}$ include the magnetic flux captured by the coil, denoted BI, produced by the magnetic circuit of the loudspeaker, the stiffness of the loudspeaker, denoted $K_{mt}(x_D)$, the viscous mechanical friction of the loudspeaker, denoted $R_{mt}$, the mobile mass of the entire loudspeaker, denoted $M_{mt}$, the stiffness of the air in the enclosure, denoted $K_{m2}$, the acoustic leakages of the enclosure, denoted $R_{m2}$ and the mass of air in the vent, denoted $M_{m2}$.

Figure 6:
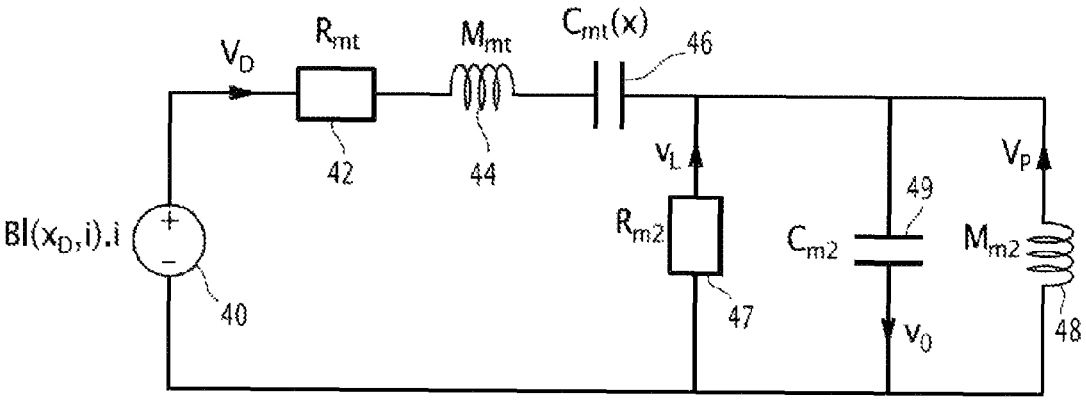
FIG. 6 is a view of a circuit representing the mechanical modeling of the loudspeaker so that it may be controlled in an enclosure provided with a vent.
Figure 7:
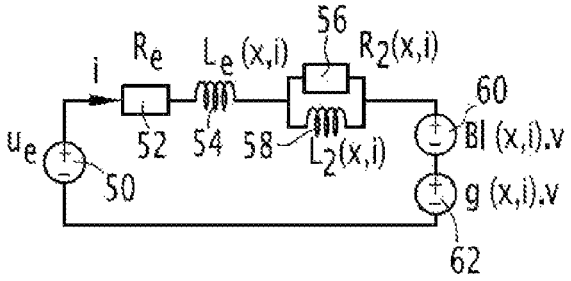
FIG. 7 is a view of a circuit representing the electrical modeling of the loudspeaker so that it may be controlled.

The model of the mechanical-acoustic part of the loudspeaker placed in a vented enclosure illustrated in FIG. 6 comprises, in a single closed-loop circuit, a voltage $BI(x_D, i)$.i generator 40 corresponding to the driving force produced by the current i circulating in the coil of the loudspeaker. The magnetic flux $BI(x_D, i)$ depends on the position $x_D$ of the membrane as well as the intensity i circulating in the coil.

This model takes into account the viscous mechanical friction $R_{mt}$ of the diaphragm corresponding to a resistance 42 in series with a coil 44 corresponding to the overall mobile mass $M_{mt}$ of the membrane, the stiffness of the membrane corresponding to a capacitor 46 with capacity $C_{mt}(x_D)$ equal to $1/K_{mt}(x_D)$. Thus, the stiffness depends on the position $x_D$ of the diaphragm.

To account for the vent, the following parameters $R_{m2}$, $C_{m2}$ and $M_{m2}$ were used:

$R_{m2}$: acoustic leakage coefficient of the enclosure;

$M_{m2}$: inductance equivalent to the mass of air in the vent;

$$C_{m2} = \frac{1}{K_{m2}}:$$

compliance of the air in the enclosure.

In the model of FIG. 6, they respectively correspond to a resistance 47, a coil 48 and a capacitor 49 mounted in parallel.

In this model, the force resulting from the reluctance of the magnetic circuit is ignored.

The variables used are:

$$v_D = \frac{dx_D}{dt}:$$

speed of the loudspeaker membrane $$\gamma_D = \frac{dv_D}{dt}:$$

acceleration of the loudspeaker membrane $v_L$: speed of the air from air leakages $v_p$: speed of the air leaving the vent (port)

$$v_0 = \frac{dx_0}{dt} = v_D + v_L + v_p:$$

speed of the total air displaced by the diaphragm and the vent;

$$\gamma_0 = \frac{dv_0}{dt}:$$

acceleration of the total displaced air.

The total acoustic pressure at 1 meter is given by:

$$p = \frac{\rho, S_D}{n_{str}\pi.}\gamma_0$$

where $S_D$: cross section of the loudspeaker, $n_{st}$=2: solid emission angle.

Figure 10:
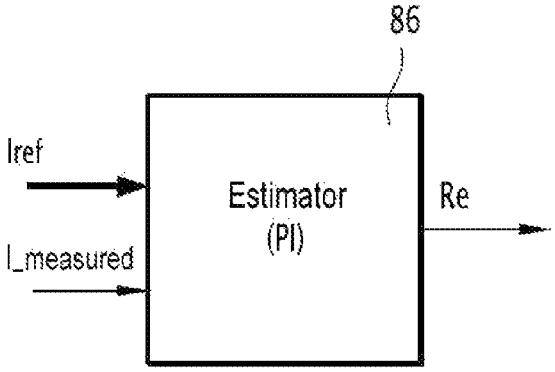
FIG. 10 is a diagrammatic view identical to that of FIG. 8 of an alternative embodiment of the closed loop estimating unit for the resistance of the loudspeaker.

The mechanical-acoustic equation corresponding to FIG. 10 is the following:

$$Bl(x_D, i)i = M_{mt}\frac{dv_D}{dt} + R_{mt}v_D + K_{mt}(x_D)x_D + K_{m2}x_0$$

The following relationship links the different values:

$$\gamma_0 = \gamma_D - \frac{K_{m2}}{R_{m2}}v_0 - \frac{K_{m2}}{M_{m2}}x_0$$

The modeling of the electric part of the loudspeaker is illustrated by FIG. 7.

The electric parameters $P_{élec}$ include the inductance of the coil $L_e$, the para-inductance $L_2$ of the coil and the iron loss equivalent $R_2$.

The modeling of the electric part of the loudspeaker illustrated by FIG. 7 is formed by a closed-loop circuit. It comprises a generator 50 for generating electromotive force connected in series to a resistance 52 representative of the resistance $R_e$ of the coil of the loudspeaker. This resistance 52 is connected in series with an inductance $L_e(X_D, i)$ representative of the inductance of the loudspeaker coil. This inductance depends on the intensity i circulating in the coil and the position $x_D$ of the diaphragm.

To account for magnetic losses and inductance variations by Foucault current effect, a parallel circuit RL is mounted in series at the output of the coil 54. A resistance 56 with value $R_2(x_D, i)$ depending on the position of the diaphragm $x_D$ and the intensity i circulating in the coil is representative of the iron loss equivalent. Likewise, a coil 58 with inductance $L_2(x_D, i)$ also depending on the position $x_D$ of the diaphragm and the intensity i circulating in the circuit is representative of the para-inductance of the loudspeaker.

Also mounted in series in the model are a voltage generator 60 producing a voltage $BI(x_D, i).v$ representative of the counter-electromotive force of the coil moving in the magnetic field produced by the magnet and a second generator 62 producing a voltage $g(x_D,i).v$ with $$g(x_D, i) = i\frac{dL_g(z_D, i)}{dx_D}$$

representative of the effect of the dynamic variation of the inductance with the position.

In general, it will be noted that, in this model, the flux BI captured by the coil, the stiffness $K_{mt}$ and the inductance of the coil $L_e$ depend on the position $x_D$ of the diaphragm, the inductance $L_e$ and the flux BI also depend on the current i circulating in the coil.

Preferably, the inductance of the coil $L_e$, the inductance $L_2$ and the term g depend on the intensity i, in addition to depending on the movement $x_D$ of the diaphragm.

From the models explained in light of FIGS. 6 and 7, the following equations are defined:

$$u_e = R_e i + L_e(x_D, i)\frac{di}{dt} + R_2(i - i_2) + Bl(x_D, i)v_D + i\underbrace{\frac{dL_e(x_D, i)}{dx_D}}_{g(x_D,i)}v_D$$

$$L_2\frac{di_2}{dt} = R_2(i - i_2)$$

$$Bl(x_D, i)i = R_{mt}v_D + M_{mt}\frac{dv_D}{dt} + K_{mt}(x_D)x_D + K_{m2}x_0$$

The control module 22 further comprises a unit 70 for calculating the reference current $i_{ref}$ and its derivative $di_{ref}/dt$. This unit receives, as input, the reference dynamic values $G_{ref}$, the mechanical parameters $P_{méca}$, and the values $x_0$ and $v_0$. This calculation of the reference current $I_{ref}$ and its derivative $dI_{ref}/dt$ satisfy the following two equations:

$$G_1(x_{ref}, i_{ref})i_{ref} = R_{mt}v_{ref} + M_{mt}A_{ref} + K_{mt}(x_{ref})x_{ref} + K_{m2}x_0$$

$$\frac{d}{dt}(G_1(x_{ref}, i_{ref})i_{ref}) = R_{mt}A_{ref} + M_{mt}dA_{ref}/dt + K_{mt}(x_{ref})v_{ref} + K_{m2}v_0$$

$$\text{with } G_1(x_{ref}, i_{ref}) = Bl(x_{ref}, i_{ref}) - \frac{1}{2}i_{ref}\frac{dL_e(x_{ref}, i_{ref})}{dx}.$$

Thus, the current $i_{ref}$ and its derivative $di_{ref}/dt$ are obtained by an algebraic calculation from values of the vectors entered by an exact analytical calculation or a digital resolution if necessary based on the complexity of $G_1(x,i)$.

The derivative of the current $di_{ref}/dt$ is thus preferably obtained through an algebraic calculation, or otherwise by numerical derivation.

To avoid excessive travel of the loudspeaker diaphragm, a movement $X_{max}$ is imposed on the control module. This is made possible by the use of a separate unit 26 for calculating reference dynamic values and a structural adaptation unit 25.

The limitation of the movement is done by a "virtual wall" device that prevents the loudspeaker diaphragm from exceeding a certain limit linked to $X_{max}$. To that end, as the position $X_{ref}$ approaches its limit threshold, the energy necessary for the position to approach the virtual wall becomes increasingly great (nonlinear behavior), to be infinite on the wall with the possibility of imposing an asymmetrical behavior. To that end, the viscous mechanical friction $R_{mt}$ 42 is increased nonlinearly based on the position $x_{ref}$ of the membrane.

According to still another embodiment, to limit the travel, the acceleration $A_{ref}$ is kept dynamically within minimum and maximum limits, which guarantee that the position $X_{ref}$ of the diaphragm does not exceed $X_{max}$.

In the case where, depending on the embodiment, the travel $X_{ref}$ of the diaphragm is limited to $X_{ref_sat}$, and the acceleration of the diaphragm $A_{ref}$ to $A_{ref_sat}$, the values $x_0$ and $v_0$ are recalculated at moment n using the following algorithm:

$$\gamma_{0sat}(n) = A_{ref\ sat}(n) - \frac{K_{m2}}{R_{m2}}v_{0sat}(n-1) - \frac{K_{m2}}{M_{m2}}x_{0sat}(n-1)$$

$$v_{0sat}(n) = \text{bounded integrator of } \gamma_{0sat}(n)\text{(identical to 32)}$$

$$x_{0sat}(n) = \text{bounded integrator of } v_{0sat}(n)\text{(identical to 34)}$$

$$v_{ref\ sat}(n) = \text{bounded integrator of } A_{ref\ sat}(n)\text{(identical to 32)}$$

The calculation of the reference current $I_{ref}$ and its derivative $dI_{ref}/dt$ then satisfy the following two equations:

$$G_1(x_{ref_sat}, i_{ref})i_{ref} = R_{mt}v_{ref_sat} + M_{mt}A_{ref_sat} + K_{mt}(x_{ref_sat})x_{ref_sat} + K_{m2}x_{0_sat}$$

$$\frac{d}{dt}(G_1(x_{ref_sat}, i_{ref})i_{ref}) = R_{mt}A_{ref_sat} + M_{mt}dA_{ref_sat}/dt + K_{mt}(x_{ref_sat})v_{ref_sat} + K_{m2}v_{0_sat}$$

-continued $$\text{with } G_1(x_{ref_sat}, i_{ref}) = Bl(x_{ref_sat}, i_{ref}) - \frac{1}{2} i_{ref} \frac{dL_e(x_{ref_sat}, i_{ref})}{dx}.$$

Furthermore, the control device 22 comprises a unit 80 for estimating the resistance $R_e$ of the loudspeaker. This unit 80 receives, as input, the reference dynamic values $G_{ref}$, the intensity of the reference current $i_{ref}$ and its derivative $di_{ref}/dt$ and, depending on the considered embodiment, the temperature measured on the magnetic circuit of the loudspeaker, denoted $T_{m_mesurée}$ or the intensity measured through the coil, denoted $I_{_mesurée}$.

Figure 8:
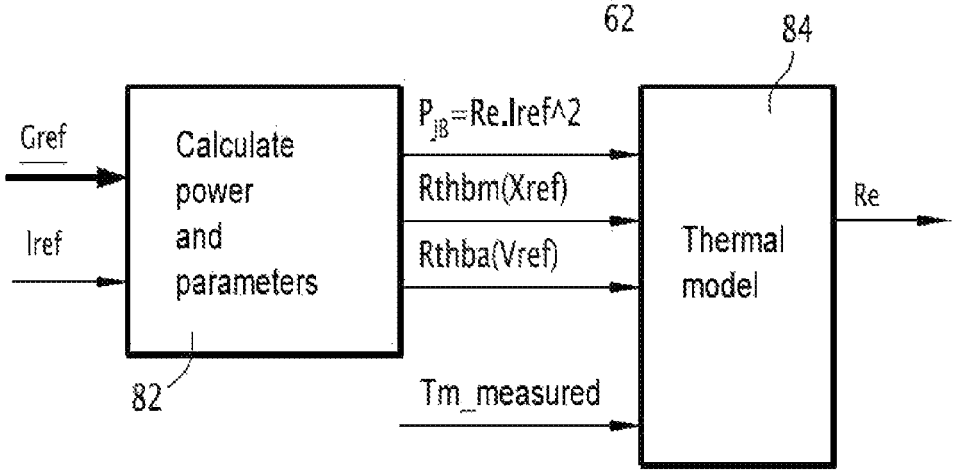
FIG. 8 is a diagrammatic view of a first embodiment of the open loop estimating unit for the resistance of the loudspeaker.

In the absence of a measurement of the circulating current, the estimating unit 80 has the form illustrated in FIG. 8. It comprises, as input, a module 82 for calculating the power and parameters and thermal model 84.

The thermal model 84 provides the calculation of the resistance $R_e$ from calculated parameters, the determined power and the measured temperature $T_{m_mesurée}$.

Figure 9:
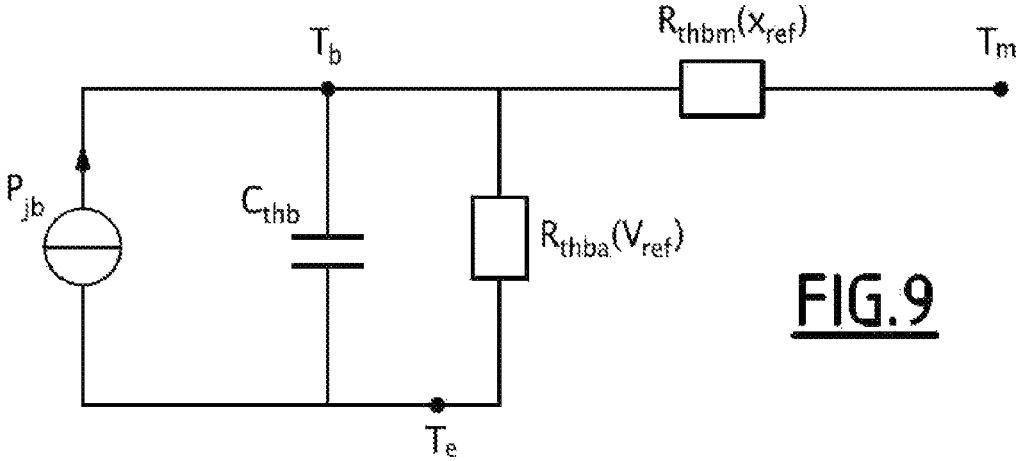
FIG. 9 is a view of a circuit of the loudspeaker thermal model.

FIG. 9 provides the general diagram used for the thermal model.

In this model, the reference temperature is the temperature of the air inside the enclosure $T_e$.

The considered temperatures are:

$T_b$ [° C.]: temperature of the winding;

$T_m$ [° C.]: temperature of the magnetic circuit; and $T_e$ [° C.]: inside temperature of the enclosure, assumed to be constant, or ideally measured.

The considered thermal power is:

$P_{Jb}$ [W]: thermal power contributed to the winding by Joule effect;

The thermal model comprises, as illustrated in FIG. 9, the following parameters:

$C_{tbb}$ [J/K]: thermal capacity of the winding;

$R_{thbm}$ [K/W]: equivalent thermal resistance between the winding and the magnetic circuit; and $R_{thba}$ [K/W]: equivalent thermal resistance between the winding and the inside temperature of the enclosure.

The equivalent thermal resistances take account of the heat dissipation by conduction and convection.

The thermal power $P_{Jb}$ contributed by the current circulating in the winding is given by:

$$P_{Jb}(t)=R_e(T_b)i^2(t)$$

where $R_e(T_b)$ is the value of the electrical resistance at the temperature $T_b$:

$$R_e(T_b)=R_e(20° \text{ C.})\times(1+4.10^{-3}(T_b-20° \text{ C.}))$$

where $R_e(20° \text{ C.})$ is the value of the electrical resistance at 20° C.

The thermal model given by FIG. 9 is the following:

$$C_{thb}\frac{dT_b}{dt} = \frac{1}{R_{thbm}(X_{ref})}(T_m - T_b) + \frac{1}{R_{thba}(V_{ref})}(T_e - T_b) + P_{Jb}$$

Its resolution makes it possible to obtain the value of the resistance $R_e$ at each moment.

Alternatively, as illustrated in FIG. 10, when the current i circulating in the coil is measured, the estimate of the resistance $R_e$ is provided by a closed-loop estimator, for example of the proportional integral type. This makes it possible to have a fast convergence time owing to the use of a proportional integral corrector.

Lastly, the control device 22 comprises a unit 90 for calculating the reference output voltage $U_{ref}$, from reference dynamic values $G_{ref}$, the reference current $i_{ref}$ and its derivative $di_{ref}/dt$, electric parameters $P_{élec}$ and the resistance $R_e$ calculated by the unit 80. This unit calculating the reference output voltage implements the following two equations:

$$u_2 + \frac{L_2(x_{ref}, i_{ref})}{R_2(x_{ref}, i_{ref})}\frac{du_2}{dt} = L_2(x_{ref}, i_{ref})\frac{di_{ref}}{dt}$$

$$u_{ref} = R_e i_{ref} + L_e(x_{ref}, i_{ref})\frac{di_{ref}}{dt} + u_2 + Bl(x_{ref}, i_{ref})v_{ref} + \frac{i_{ref}\frac{dL_e(x_{ref}, i_{ref})}{dt}}{g(x_{ref}, i_{ref})}v_{ref}$$

If the amplifier 16 is a current amplifier and not a voltage amplifier as previously described, the units 38, 80 and 90 of the control device are eliminated and the reference output intensity $i_{ref}$ controlling the amplifier is taken at the output of the unit 70.

Figure 11:
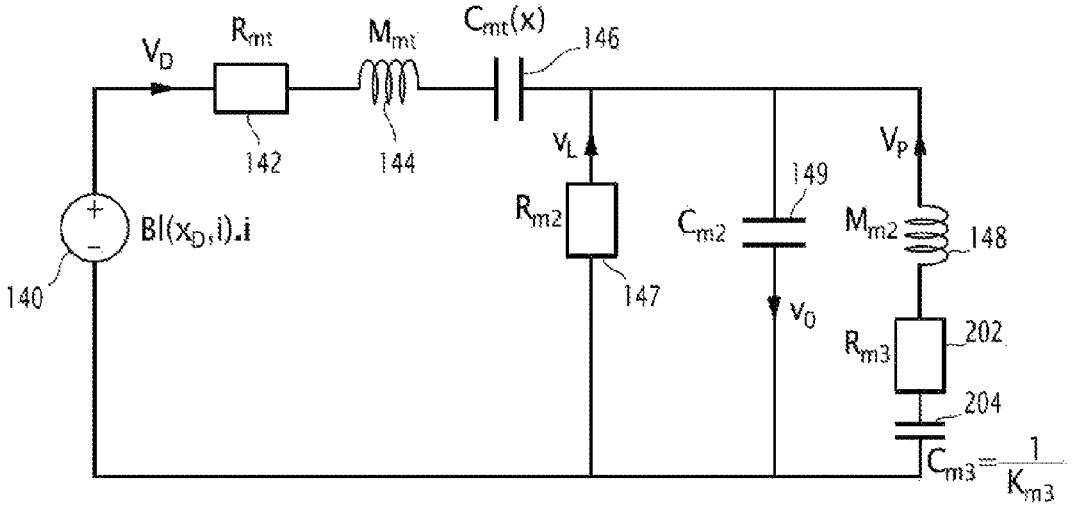
FIG. 11 is a diagrammatic view identical to that of FIG. 6 of another embodiment for an enclosure provided with a passive radiator.

In the case of an enclosure comprising a passive radiator formed by a diaphragm, the mechanical model of FIG. 6 is replaced by that of FIG. 11, in which the elements identical to those of FIG. 6 bear the same reference numbers. This module comprises, in series with the coil $M_{m2}$48, corresponding to the mass of the diaphragm of the passive radiator, a resistance 202 and a capacitor 204 with value $$C_{m3} = \frac{1}{K_{m3}}$$

respectively corresponding to the mechanical losses $R_{m2}$ of the passive radiator and the mechanical stiffness $K_{m3}$ of the diaphragm of the passive radiator. The reference acceleration of the membrane $A_{ref}$ is given by:

$$A_{ref} = \gamma_0 + \frac{K_{m2}}{R_{m2}}v_0 + \frac{K_{m2}}{M_{m2}}x_{0R}$$

with $x_{OR}$ given by filtering by a high-pass filter of $x_0$:

$$x_{0R} = \frac{S^2}{s^2 + \frac{R_{ms}}{M_{m2}}S + \frac{K_{m2}}{M_{m2}}}x_0$$

Thus, the structural adaptation structure 25 comprises, in series, two bounded integrators in order to obtain $v_0$ and $x_0$ from $\gamma_0$, then to calculate $x_{OR}$ from $x_0$ by high-pass filtering with the additional parameters $R_{m3}$ and $K_{m3}$ which are, respectively, the mechanical loss resistance and the mechanical stiffness constant of the diaphragm of the passive radiator.

The invention claimed is:

1. A device for controlling a loudspeaker in an enclosure, comprising:

an input for an audio signal to be reproduced;

an output for supplying an excitation signal from the loudspeaker;

means for calculating the excitation signal of the loudspeaker at each moment based on the audio signal;

wherein upstream, it comprises means for calculating the excitation signal, means for calculating a desired dynamic value of the diaphragm of the loudspeaker based on the audio signal to be reproduced and the structure of the enclosure, the means for calculating the desired dynamic value of the loudspeaker diaphragm being able to apply a correction that is different from the identity, and taking account of structural dynamic values of the enclosure that are different from the only dynamic values relative to the loudspeaker diaphragm, the means for calculating the excitation signal of the loudspeaker being able to calculate the excitation signal based on the desired dynamic value of the loudspeaker diaphragm.

2. The device according to claim 1, wherein the enclosure comprises a vent and the structural dynamic values of the enclosure comprise at least one derivative of predetermined order of the position of the air displaced by the enclosure.

3. The device according to claim 1 wherein the structural dynamic values of the enclosure comprise the position of the air displaced by the enclosure.

4. The device according to claim 1, wherein the structural dynamic values of the enclosure comprise the speed of the air displaced by the enclosure.

5. The device according to claim 1, wherein the enclosure is a vented enclosure and the structural dynamic values of the enclosure depend on at least one of the following parameters:

acoustic leakage coefficient of the enclosure $R_{m2}$ inductance equivalent to the mass of air in the vent $M_{m2}$ compliance of the air in the enclosure $$C_{m2} = \frac{1}{K_{m2}}.$$

6. The device according to claim 1, wherein the enclosure is a passive radiator enclosure and the structural dynamic values of the enclosure depend on at least one of the following parameters:

acoustic leakage coefficient of the enclosure $R_{m2}$ inductance equivalent to the mass of the diaphragm of the passive radiator $M_{m2}$ compliance of the air in the enclosure $$C_{m2} = \frac{1}{K_{m2}}$$

mechanical losses of the passive radiator $R_{m3}$ mechanical compliance of the diaphragm $$C_{m3} = \frac{1}{K_{m3}}.$$

* * * * *